US008777449B2

(12) United States Patent
Van De Ven et al.

(10) Patent No.: US 8,777,449 B2
(45) Date of Patent: Jul. 15, 2014

(54) LIGHTING DEVICES COMPRISING SOLID STATE LIGHT EMITTERS

(75) Inventors: Antony Paul Van De Ven, Hong Kong (CN); Wai Kwan Chan, Hong Kong (CN); Ho Chin Wah, Hong Kong (CN)

(73) Assignee: Cree, Inc., Durham, NC (US)

( * ) Notice: Subject to any disclaimer, the term of this patent is extended or adjusted under 35 U.S.C. 154(b) by 319 days.

(21) Appl. No.: 12/566,861

(22) Filed: Sep. 25, 2009

(65) Prior Publication Data

US 2011/0075422 A1 Mar. 31, 2011

(51) Int. Cl.
*F21S 4/00* (2006.01)

(52) U.S. Cl.
USPC ..... 362/249.02; 362/401; 362/407; 362/640; 362/646

(58) Field of Classification Search
USPC ..... 362/340, 646, 650, 249.02, 401, 407
See application file for complete search history.

(56) References Cited

U.S. PATENT DOCUMENTS

| | | | |
|---|---|---|---|
| 446,142 | A | 2/1891 | Martin |
| D188,916 | S | 9/1960 | Harling |
| D207,867 | S | 6/1967 | Pettengill |
| 3,560,728 | A | 2/1971 | Atkin |
| 3,755,697 | A | 8/1973 | Miller |
| 3,787,752 | A | 1/1974 | Delay |
| 4,090,189 | A | 5/1978 | Fisler |
| 4,717,868 | A | 1/1988 | Peterson |
| 4,798,983 | A | 1/1989 | Mori |
| 4,839,535 | A | 6/1989 | Miller |
| 4,841,422 | A | 6/1989 | Groh |
| 4,918,487 | A | 4/1990 | Coulter, Jr. |
| 5,138,541 | A | 8/1992 | Kano |
| 5,151,679 | A | 9/1992 | Dimmick |
| 5,175,528 | A | 12/1992 | Choi et al. |
| 5,345,167 | A | 9/1994 | Hasegawa et al. |
| 5,397,938 | A | 3/1995 | Wilheim et al. |
| 5,528,467 | A | 6/1996 | Jiang |

(Continued)

FOREIGN PATENT DOCUMENTS

| | | |
|---|---|---|
| CN | 101162745 | 4/2008 |
| EP | 1 881 259 | 1/2008 |

(Continued)

OTHER PUBLICATIONS

U.S. Appl No. 29/344,219, filed Sep. 25, 2009, Van de Ven.

(Continued)

*Primary Examiner* — Anabel Ton
(74) *Attorney, Agent, or Firm* — Burr & Brown, PLLC

(57) ABSTRACT

A lighting device comprising a trim element, an electrical connector and at least one solid state light emitter, the lighting device weighing less than one kilogram. If current of about 12 watts (or in some cases about 15 watts, or in some cases not more than about 15 watts) is supplied to the electrical connector, the at least one solid state light emitter will illuminate so that the lighting device will emit white light of at least 500 lumens. Also, a lighting device that weighs less than one kilogram and can generate white light of at least 500 lumens using a current of not more than about 15 watts. Also, a lighting device for mounting in a recessed housing, comprising a unitary structure trim element that conducts heat away from at least one solid state light emitter and dissipates at least some of the heat outside of the recessed housing.

14 Claims, 5 Drawing Sheets

(56) References Cited

U.S. PATENT DOCUMENTS 5,631,190 A 5/1997 Negley
5,661,645 A 8/1997 Hochstein
D384,430 S 9/1997 Lecluze
5,736,881 A 4/1998 Ortiz
5,803,579 A 9/1998 Turnbull et al.
D400,280 S 10/1998 Leen
5,844,377 A 12/1998 Anderson et al.
5,912,477 A 6/1999 Negley
5,912,568 A 6/1999 Kiley
D418,620 S 1/2000 Grossman
D425,024 S 5/2000 Klaus et al.
6,079,852 A 6/2000 Kamaya et al.
6,150,771 A 11/2000 Perry
6,161,910 A 12/2000 Reisenauer et al.
D437,439 S 2/2001 Tang
6,222,172 B1 4/2001 Fossum et al.
6,264,354 B1 7/2001 Motilal
6,285,139 B1 9/2001 Ghanem
6,329,760 B1 12/2001 Bebenroth
6,340,868 B1 1/2002 Lys et al.
6,350,041 B1 2/2002 Tarsa et al.
6,362,578 B1 3/2002 Swanson et al.
6,388,393 B1 5/2002 Illingworth
6,400,101 B1 6/2002 Biebl et al.
6,528,954 B1 3/2003 Lys et al.
6,577,072 B2 6/2003 Saito et al.
6,586,890 B2 7/2003 Min et al.
6,600,175 B1 7/2003 Baretz et al.
6,614,358 B1 9/2003 Hutchison et al.
6,636,003 B2 10/2003 Rahm et al.
6,724,376 B2 4/2004 Sakura et al.
D490,181 S 5/2004 Redfern
6,747,420 B2 6/2004 Barth et al.
6,755,550 B1 * 6/2004 Lackey ..... 362/147
6,791,840 B2 9/2004 Chun
6,808,287 B2 10/2004 Lebens et al.
6,836,081 B2 12/2004 Swanson et al.
6,841,947 B2 1/2005 Berg-johansen
6,873,203 B1 3/2005 Latham, II et al.
6,987,787 B1 1/2006 Mick
6,995,518 B2 2/2006 Havlik et al.
7,014,341 B2 * 3/2006 King et al. ..... 362/296.02
7,038,399 B2 5/2006 Lys et al.
7,071,762 B2 7/2006 Xu et al.
7,081,722 B1 7/2006 Huynh et al.
7,088,059 B2 8/2006 McKinney et al.
7,108,238 B2 9/2006 Gauci
7,119,498 B2 10/2006 Baldwin et al.
7,144,140 B2 12/2006 Sun et al.
7,180,487 B2 2/2007 Kamikawa et al.
7,202,608 B2 4/2007 Robinson et al.
7,213,940 B1 5/2007 Van de Ven
D544,979 S 6/2007 Hartmann et al.
7,226,189 B2 6/2007 Lee et al.
D557,853 S 12/2007 Sandell
D558,374 S 12/2007 Sandell
7,408,308 B2 8/2008 Sawada et al.
D576,964 S 9/2008 Shaner
7,458,706 B1 12/2008 Liu et al.
7,513,639 B2 4/2009 Wang
7,566,154 B2 7/2009 Gloisten et al.
7,614,767 B2 * 11/2009 Zulim et al. ..... 362/296.01
7,614,769 B2 * 11/2009 Sell ..... 362/365
7,628,513 B2 12/2009 Chiu
7,637,635 B2 12/2009 Xiao et al.
D610,291 S 2/2010 Yoshinobu et al.
7,677,767 B2 3/2010 Chyn
D618,376 S 6/2010 Redfern et al.
7,758,223 B2 7/2010 Osawa et al.
7,780,318 B2 8/2010 Xiao
D625,038 S 10/2010 Yoo
D627,502 S 11/2010 Zheng et al.
D627,911 S 11/2010 Mo et al.
7,824,075 B2 11/2010 Maxik
7,862,201 B2 1/2011 Ge et al.
7,862,214 B2 1/2011 Trott et al.
7,871,184 B2 1/2011 Peng
D633,099 S 2/2011 Van de Ven et al.
7,914,902 B2 3/2011 Kao et al.
D636,921 S 4/2011 Van de Ven et al.
D636,922 S 4/2011 Yoshida et al.
D638,160 S 5/2011 Van de Ven et al.
7,994,725 B2 8/2011 Bouchard
8,008,845 B2 8/2011 Van de Ven
D646,011 S 9/2011 Rashidi
8,157,422 B2 4/2012 Paik et al.
8,235,555 B2 8/2012 Thomas et al.
8,246,202 B2 8/2012 Mart et al.
2002/0097095 A1 7/2002 Jeon et al.
2005/0007164 A1 1/2005 Callahan
2005/0111222 A1 5/2005 Olsson et al.
2005/0128752 A1 6/2005 Ewington et al.
2005/0169015 A1 8/2005 Luk et al.
2005/0174065 A1 8/2005 Janning
2005/0242742 A1 11/2005 Cheang et al.
2005/0276053 A1 12/2005 Nortrup et al.
2006/0244396 A1 11/2006 Bucur
2006/0255753 A1 11/2006 Sawada et al.
2007/0108843 A1 5/2007 Preston et al.
2007/0137074 A1 6/2007 Van de Ven
2007/0139920 A1 6/2007 Van de Ven
2007/0139923 A1 6/2007 Negley
2007/0170447 A1 7/2007 Negley
2007/0171145 A1 7/2007 Coleman
2007/0215027 A1 9/2007 MacDonald et al.
2007/0236911 A1 10/2007 Negley
2007/0236920 A1 10/2007 Snyder
2007/0247414 A1 10/2007 Roberts
2007/0263393 A1 11/2007 Van de Ven
2007/0267983 A1 11/2007 Van de Ven
2007/0274063 A1 11/2007 Negley
2007/0274080 A1 11/2007 Negley
2007/0278503 A1 12/2007 Van de Ven
2007/0278934 A1 12/2007 Van de Ven
2007/0278974 A1 12/2007 Van de Ven
2007/0279440 A1 12/2007 Negley
2007/0279903 A1 12/2007 Negley
2007/0280624 A1 12/2007 Negley
2008/0030993 A1 2/2008 Narendran et al.
2008/0054281 A1 3/2008 Narendran et al.
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0089071 A1 4/2008 Wang
2008/0094000 A1 4/2008 Yamamoto et al.
2008/0094829 A1 4/2008 Narendran et al.
2008/0105887 A1 5/2008 Narendran et al.
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0117500 A1 5/2008 Narendran et al.
2008/0128718 A1 6/2008 Sumitani
2008/0130285 A1 6/2008 Negley
2008/0136313 A1 6/2008 Van de Ven
2008/0137347 A1 6/2008 Trott
2008/0186704 A1 8/2008 Chou et al.
2008/0211415 A1 9/2008 Altamura
2008/0259589 A1 10/2008 Van de Ven
2008/0278928 A1 11/2008 Van de Ven
2008/0278940 A1 11/2008 Van de Ven
2008/0278950 A1 11/2008 Pickard et al.
2008/0278952 A1 11/2008 Trott
2008/0278957 A1 11/2008 Pickard et al.
2008/0304260 A1 12/2008 Van de Ven
2008/0304261 A1 12/2008 Van de Ven
2008/0304269 A1 12/2008 Pickard
2008/0309255 A1 12/2008 Myers

(56) References Cited

U.S. PATENT DOCUMENTS

| | | | |
|---|---|---|---|
| 2009/0034283 | A1 | 2/2009 | Albright et al. |
| 2009/0046464 | A1 | 2/2009 | Liu et al. |
| 2009/0059582 | A1 | 3/2009 | Kulkarni |
| 2009/0086474 | A1 | 4/2009 | Chou |
| 2009/0101930 | A1 | 4/2009 | Li |
| 2009/0108269 | A1 | 4/2009 | Negley |
| 2009/0147517 | A1 | 6/2009 | Li et al. |
| 2009/0160363 | A1 | 6/2009 | Negley |
| 2009/0161356 | A1 | 6/2009 | Negley |
| 2009/0184616 | A1 | 7/2009 | Van de Ven |
| 2009/0184662 | A1 | 7/2009 | Given et al. |
| 2009/0184666 | A1 | 7/2009 | Myers |
| 2009/0196037 | A1 | 8/2009 | Xiao et al. |
| 2009/0296384 | A1 | 12/2009 | Van de Ven |
| 2010/0014289 | A1 | 1/2010 | Thomas et al. |
| 2010/0027258 | A1 | 2/2010 | Maxik et al. |
| 2010/0060130 | A1 | 3/2010 | Li |
| 2010/0060175 | A1 | 3/2010 | Lethellier |
| 2010/0067227 | A1 | 3/2010 | Budike |
| 2010/0079059 | A1 | 4/2010 | Roberts et al. |
| 2010/0079262 | A1 | 4/2010 | Van Laanen |
| 2010/0102199 | A1 | 4/2010 | Negley et al. |
| 2010/0102697 | A1 | 4/2010 | Van De Ven et al. |
| 2010/0103678 | A1 | 4/2010 | Van De Ven et al. |
| 2010/0109570 | A1 | 5/2010 | Weaver |
| 2010/0135016 | A1 | 6/2010 | Ishibashi |
| 2010/0177509 | A1 | 7/2010 | Pickard |
| 2010/0225220 | A1 | 9/2010 | Tanaka et al. |
| 2010/0246177 | A1 | 9/2010 | Van de Ven |
| 2010/0246197 | A1 | 9/2010 | Takahashi et al. |
| 2010/0308739 | A1 | 12/2010 | Shteynberg et al. |
| 2010/0327746 | A1 | 12/2010 | Hisayasu |
| 2011/0031894 | A1 | 2/2011 | Van de Ven |
| 2011/0068696 | A1 | 3/2011 | Van de Ven |
| 2011/0068702 | A1 | 3/2011 | Van de Ven |
| 2011/0074265 | A1 | 3/2011 | Van de Ven et al. |
| 2011/0074289 | A1 | 3/2011 | Van de Ven |
| 2011/0075411 | A1 | 3/2011 | Van de Ven et al. |
| 2011/0075414 | A1 | 3/2011 | Van de Ven et al. |
| 2011/0075422 | A1 | 3/2011 | Van de Ven et al. |
| 2011/0075423 | A1 | 3/2011 | Van de Ven |
| 2011/0169417 | A1 | 7/2011 | Hum et al. |
| 2011/0180818 | A1 | 7/2011 | Lerman et al. |
| 2011/0181194 | A1 | 7/2011 | Hum et al. |
| 2011/0198984 | A1 | 8/2011 | Van de Ven |
| 2011/0211351 | A1 | 9/2011 | Van de Ven |

FOREIGN PATENT DOCUMENTS

| | | |
|---|---|---|
| WO | 2006/007388 | 1/2006 |
| WO | 2008/036873 | 3/2008 |
| WO | 2008/051957 | 5/2008 |
| WO | 2008/061082 | 5/2008 |
| WO | 2008/129504 | 10/2008 |

OTHER PUBLICATIONS

U.S. Appl No. 29/353,900, filed Jan. 15, 2010, Van de Ven.
U.S. Appl. No. 12/535,319, filed Aug. 4, 2009.
U.S. Appl. No. 12/441,905, filed Mar. 26, 2009.
U.S. Appl. No. 12/566,936, filed Sep. 25, 2009.
U.S. Appl. No. 12/566,850, filed Sep. 25, 2009.
U.S. Appl. No. 12/566,857, filed Sep. 25, 2009.
U.S. Appl. No. 12/621,970, filed Nov. 19, 2009.
U.S. Appl. No. 12/704,995, filed Feb. 12, 2010.
U.S. Appl. No. 12/566,142, filed Sep. 24, 2009.
U.S. Appl. No. 12/566,195, filed Sep. 24, 2009.
"Assist Recommends . . . LED Life for General Lighting: Definition of Life", vol. 1, Issue 1, Feb. 2005.
*"Bright Tomorrow Lighting Competition (L prize™)"*, May 28, 2008, Document No. 08NT006643.
*"Energy Star™ Program Requirements for Solid State Lighting Luminaires, Eligibily Criteria—Version 1.1"*, Final: Dec. 19, 2008.
Application Note: CLD-AP06.006, entitled *Cree® XLamp® XR Family* & 4550 LED Reliability, published at cree.com/xlamp, Sep. 2008.
Bulborama, Lighting Terms Reference and Glossary, http://www.bulborama.com/storelightingreferenceglossary-13.html, 6 pages.
DuPont, *"DuPont™ Diffuse Light Reflector"*, Publication K-20044, May 2008, 2 pages.
Furukawa Electric Co., Ltd., Data Sheet, *"New Material for Illuminated Panels Microcellular Reflective Sheet MCPET"*, updated Apr. 8, 2008, 2 pages.
Illuminating Engineering Society Siandard LM-80-08, entitled *"IES Approved Method for Measuring Lumen Maintenance of LED Light Sources"*, Sep. 22, 2008, ISBN No. 978-0-87995,227-3.
Kim et al., "Strongly Enhanced Phosphor Efficiency in GaInN White Light-Emitting Diodes Using Remote Phosphor Configuration and Diffuse Reflector Cup" *Japanese Journal of Applied Physics* 44(21):L649-L651 (2005).
LEDs Magazine, Press Release May 23, 2007, *"Furukawa America Debuts MCPET Reflective Sheets to Improve Clarity, Efficiency of Lighting Fixtures"*, downloaded Jun. 25, 2009 from http://www.ledsmagazine.com/press/15145, 2 pages.
Philips Lumileds, Technology White Paper: "Understanding power LED lifetime analysis", downloaded from http://www.philipslumileds.com/pdfs/WP12.pdf, Document No. WP12, Last Modified May 22, 2007.
MCPET—Microcellular Reflective Sheet Properties, http://www.trocellen.com, downloaded Jun. 25, 2009, 2 pages.
Chinese Office Action (and translation provided by foreign counsel) from a corresponding Chinese patent application bearing a mailing date of Dec. 19, 2013, 14 pages.

* cited by examiner

LIGHTING DEVICES COMPRISING SOLID STATE LIGHT EMITTERS

FIELD OF THE INVENTIVE SUBJECT MATTER

The present inventive subject matter is directed to lighting devices. In some aspects, the present inventive subject matter is directed to lighting devices that comprise one or more solid state light emitters, e.g., one or more light emitting diodes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs generally have lifetimes (e.g., 10,000-20,000 hours) that are longer than those of incandescent lights, but they typically provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

There are a number of challenges presented with using light emitting diodes in lighting devices. In many cases, additional components are added to the lighting devices in order to address these challenges. Additional components tend to increase the weight of lighting devices, as well as the size of lighting devices. It would be desirable to provide a lighting device that comprises one or more solid state light emitters, in which such challenges are addressed and yet the lighting device is lightweight and/or can fit within the same or substantially the same space that is provided for comparable conventional lighting devices (e.g., lighting devices that include one or more incandescent light sources and/or one or more fluorescent light sources). The ability for the lighting device to be lightweight and/or to fit in a space that is similar to (or identical to) a space into which conventional devices can fit is important when retro-fitting a lighting device, as well when installing a lighting device in new construction (let alone when shipping it).

One such challenge results from the fact that the emission spectrum of any particular light emitting diode is typically concentrated around a single wavelength (as dictated by the light emitting diode's composition and structure), which is desirable for some applications, but not desirable for others, (e.g., for providing general illumination, such an emission spectrum generally does not provide light that appears white, and/or provides a very low CRI). As a result, in many cases (e.g., to make devices that emit light perceived as white or near-white, or to make devices that emit light that is not highly saturated) it is necessary to employ light sources (e.g., one or more solid state light emitters and optionally also one or more other types of light sources, e.g., additional light emitting diodes, luminescent materials, incandescent lights, etc.) that emit light of different colors. There are a variety of reasons that one or more solid state light emitters might cease emitting light and/or vary in their intensity of light emission, which can throw off the balance of color output and cause the lighting device to emit light that is perceived as being of a color that differs from the desired color of light output. As a result, in many of such devices, one challenge that necessitates the inclusion of additional components, is that there may be a desire to provide additional circuitry that can adjust the current supplied to respective solid state light emitters (and/or other light emitters) in order to maintain the balance of color output among the light emitters that emit light of different colors in order to achieve the desired color output. Another such challenge is that there may be a desire to mix the light of different colors emitted from the different solid state light emitters by providing additional structure to assist in such mixing.

One example of a reason that one or more solid state light emitters might vary in their intensity of light emission is temperature change (resulting, e.g., from change in ambient temperature and/or heating up of the solid state light emitters). Some types of solid state light emitters (e.g., solid state light emitters that emit light of different colors) experience differences in intensity of light emission (if supplied with the same current) at different temperatures, and frequently such changes in intensity occur to differing extents for emitters that emit light of different colors as temperature changes. For example, some light emitting diodes that emit red light have a very strong temperature dependence in at least some temperature ranges (e.g., AlInGaP light emitting diodes can reduce in optical output by ~20% when heated up by ~40 degrees C., that is, approximately −0.5% per degree C.; some blue light emitting InGaN+YAG:Ce light emitting diodes can reduce in optical output by about −0.15%/degree C.).

Another example of a reason that one or more solid state light emitters might vary in their intensity of light emission is aging. Some solid state light emitters (e.g., solid state light emitters that emit light of different colors) experience decreases in intensity of light emission (if supplied with the same current) as they age, and frequently such decreases in intensity occur at differing rates.

Another example of a reason that one or more solid state light emitters might vary in their intensity of light emission is damage to the solid state light emitter(s) and/or damage to circuitry that supplies current to the solid state light emitter(s).

Another challenge presented in making a lighting device with light emitting diodes, that often necessitates the inclusion of additional components, is that the performance of many solid state light emitters may be reduced when they are subjected to elevated temperatures. For example, many light emitting diode light sources have average operating lifetimes of decades as opposed to just months or 1-2 years for many incandescent bulbs, but some light emitting diodes' lifetimes can be significantly shortened if they are operated at elevated temperatures. A common manufacturer recommendation is that the junction temperature of a light emitting diode should not exceed 85 degrees C. if a long lifetime is desired. There may be a desire to counteract such problems, in many instances, by providing additional structure (or structures) to provide a desired degree of heat dissipation.

Another challenge presented in making a lighting device with light emitting diodes, that often necessitates the inclusion of additional components, arises from the relatively high light output from a relatively small area provided by solid state emitters. Such a concentration of light output may present challenges in providing solid state lighting systems for general illumination in that, in general, a large difference in brightness in a small area may be perceived as glare and may be distracting to occupants. In many instances, therefore, there is a desire to provide additional structure to assist in mixing the emitted light and/or creating the perception that the emitted light is output through a larger area.

Another challenge presented in making a lighting device with light emitting diodes, that often necessitates the inclusion of additional components, is that light emitting diodes are typically run most effectively on low voltage DC current, while line voltage typically is much higher voltage AC current. As a result, there is often a desire to provide circuitry that converts line voltage, e.g., from AC to DC and/or that reduces voltage.

In addition, in some circumstances, there is a desire either to retrofit or install a lighting device in a circuit that has a conventional dimmer. Some dimmers operate based on signals contained in the current supplied to the lighting device (for example, duty cycle of an AC signal, e.g., from a triac), for which additional circuitry is generally needed. An example of a lighting device that includes some or all of these various additional components, retrofits into many conventional recessed lighting housings and works with many conventional dimmers is the LR6 from Cree LED Lighting Solutions of Morrisville, N.C. The LR6 is a 6 inch recessed downlight that provides 650 delivered lumens of light, consumes only 12 watts of electrical power and has a CRI of 92. The LR6 weighs slightly less than 1 kg.

It would be desirable to be able to make lighting devices that include solid state light emitters in order to achieve high wall plug efficiency, while providing consistently good color quality, suitable brightness and good solid state light emitter lifetimes, in a lighting device that is of light weight (e.g., in comparison to other lighting devices that comprise solid state light emitters, for example, devices that comprise one or more solid state light emitters and that provide some or all of the features described herein).

BRIEF SUMMARY OF THE INVENTIVE SUBJECT MATTER

In some aspects, the present inventive subject matter provides lighting devices (and lighting devices that can provide such features, e.g., in which high efficiency, consistently good output light color quality, good solid state light emitter lifetime, suitable brightness and light weight are all provided.

In some embodiments according to the present inventive subject matter, including some embodiments that include or do not include any of the features as discussed herein, (1) a single element performs two or more functions that are performed by plural elements in other lighting devices, (2) heat dissipation is provided to some degree by the trim element, and/or (3) fewer interfaces have to be crossed by heat on its way to being dissipated (e.g., in some embodiments, one or more solid state light emitters can be mounted on the trim element).

In accordance with an aspect of the present inventive subject matter, there is provided a lighting device that comprises a trim element.

In accordance with another aspect of the present inventive subject matter, there is provided a lighting device that comprises a trim element and at least one solid state light emitter, and in which the lighting device weighs not greater than one kilogram (and in some cases not greater than about 2.4 pounds, in some cases less, e.g., not greater than about 750 grams or not greater than about 500 grams, or not greater than about 14, 12, 10 or 9 ounces).

In some embodiments according to the present inventive subject matter, including some embodiments that include or do not include any of the features as discussed herein, if a current (e.g., AC or DC current) of about 12 watts (in some cases, 13 watts, 14 watts, 15 watts or less than 15 watts, e.g., in some cases about 11 watts, 10 watts, 9 watts 8 watts (or less) is supplied to the lighting device, light having a brightness of at least about 500 lumens will be emitted by the lighting device (in some cases, at least about 400 lumens, 425 lumens, 450 lumens, 475 lumens, 525 lumens, 550 lumens, 575 lumens, 600 lumens, 700 lumens, 800 lumens, 900 lumens, 1000 lumens or more, can be generated by supplying current of 12 watts, or any of such lumen outputs can be achieved by supplying current of 8 watts, 9 watts, 10 watts, 11 watts, 13 watts, 14 watts, or 15 watts). In some embodiments, the lighting device has an aperture diameter of about 4.5 inches or greater and delivers at least 575 lumens of light.

In some embodiments according to the present inventive subject matter, including some embodiments that include or do not include any of the features as discussed herein, the lighting device emits white light.

In some embodiments according to the present inventive subject matter, including some embodiments that include or do not include any of the features as discussed herein, the lighting device emits light at a shield angle of at least 15 degrees.

In some embodiments according to the present inventive subject matter, including some embodiments that include or do not include any of the features as discussed herein, if a current is supplied to the lighting device to cause the lighting device to emit light having a brightness of at least 500 lumens (or at least about 400 lumens, 425 lumens, 450 lumens, 475 lumens, 525 lumens, 550 lumens, 575 lumens, 600 lumens, 700 lumens, 800 lumens, 900 lumens, 1000 lumens or more), the temperature of the at least one solid state light emitter will be maintained at or below a 25,000 hour rated lifetime junction temperature (and in some embodiments, at least a 35,000 hour rated lifetime junction temperature or at least a 50,000 hour rated lifetime junction temperature) for the solid state light emitter in a 25° C. surrounding environment (and, in some embodiments, in a 30° C. surrounding environment, or a 35° C. or higher surrounding environment).

In some embodiments according to the present inventive subject matter, including some embodiments that include or do not include any of the features as discussed herein, the lighting device has a wall plug efficiency of at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt.

In some embodiments according to the present inventive subject matter, including some embodiments that include or do not include any of the features as discussed herein, at least one of the at least one solid state light emitter is mounted on the trim element.

In some embodiments according to the present inventive subject matter, including some embodiments that include or do not include any of the features as discussed herein, the trim element comprises at least a portion of a mixing chamber sub-assembly.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
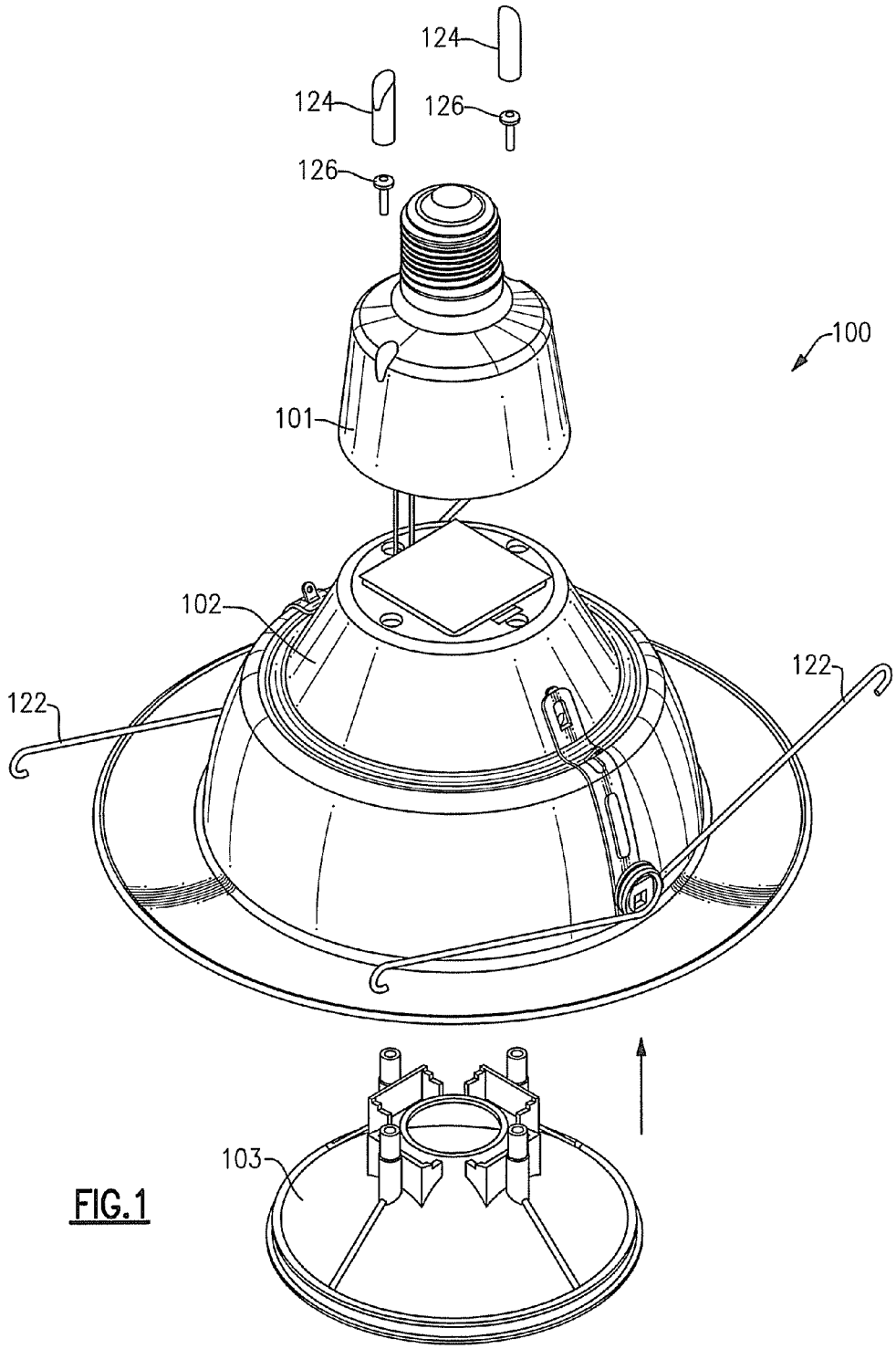
FIG. 1 is an exploded perspective view of a lighting device 100.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some electromagnetic radiation (e.g., visible light). The expression "illuminated" encompasses situations where the solid state light emitter emits electromagnetic radiation continuously, or intermittently at a rate such that a human eye would perceive it as emitting electromagnetic radiation continuously or intermittently, or where a plurality of solid state light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "shield angle", as used herein, means a minimum angle, relative to a surface in which a lighting device is mounted, defined by a line segment extending from the lighting device to a location from which the solid state light emitter (or solid state light emitters) and/or the lens in the lighting device cannot be seen directly (e.g., the solid state light emitter(s) or lens is/are blocked from view by a portion of the lighting device). Accordingly, if a shield angle of a lighting device is specified as being at least equal to a particular angle (e.g., at least 15 degrees), then if a line segment connecting the location to the lighting device defines an angle (relative to a surface in which the lighting device is mounted, e.g., a ceiling) of 15 degrees or more, none of the light exiting the lighting device can travel directly from a solid state light emitter (or a lens) to the location. In other words, if for example a person starts from a location directly underneath a recessed downlight that has a lens and moves away from that location, at some point, the person reaches a position where the lens of the recessed downlight is shielded from view; the farther the person moves, the smaller the angle becomes. Accordingly, if a lighting device has a higher minimum shield angle (all other things being equal), the person would have to move a shorter distance before the recessed downlight is shielded from view (i.e., the person starts at a location which, together with the lighting device, defines an angle of 90 degrees relative to the surface in which the lighting device is mounted, and as he or she moves, the angle becomes smaller). Therefore, for example, the farther a lighting device is recessed (if at all), the higher the shield angle would be.

The color of visible light output by a light emitter, and/or the color of blended visible light output by a plurality of light emitters can be represented on either the 1931 CIE (Commission International de l'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular color. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\ \lambda^{-5}/(e^{(B/T)}-1)$, where E is the emission intensity, λ is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

The expression "white light", as used herein, means light that has a color point that is spaced by from the nearest point on the blackbody locus in a 1976 CIE Chromaticity Diagram by not more than a unit distance of 0.01 (in the scale of u' v' coordinates), or that is within 10 MacAdams ellipses. In some embodiments of the present inventive subject matter, including some embodiments that include or do not include any of the features as discussed herein, the lighting device emits light that is within five MacAdam ellipses, in some cases within three MacAdam ellipses, of at least one point on the blackbody locus.

The expression "wall plug efficiency", as used herein, is measured in lumens per watt, and means lumens exiting a lighting device, divided by all energy supplied to create the light, as opposed to values for individual components and/or assemblies of components. Accordingly, wall plug efficiency, as used herein, accounts for all losses, including, among others, any quantum losses, i.e., the ratio of the number of photons emitted by luminescent material(s) divided by the number of photons absorbed by the luminescent material(s), any Stokes losses, i.e., losses due to the change in frequency involved in the absorption of light and the re-emission of visible light (e.g., by luminescent material(s)), losses generated in converting line voltage into current supplied to light emitters, and any optical losses involved in the light emitted by a component of the lighting device actually exiting the lighting device. In some embodiments, the lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that teens, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in some aspects, the present inventive subject matter is directed to a lighting device that comprises a trim element, an electrical connector and at least one solid state light emitter.

The trim element can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments, the trim element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments according to the present inventive subject matter, the trim element can comprise a mixing chamber sub-assembly, or at least a portion thereof (e.g., a single structure can be provided which acts as the trim element and as a mixing chamber sub-assembly, and/or a mixing chamber sub-assembly can be integral with the trim element, and/or the trim element can comprise a region that functions as a mixing chamber sub-assembly). In some embodiments, such structure can also comprise some or all of the thermal management system for the lighting device. By providing such a structure, it is possible to reduce or minimize the thermal interfaces between the solid state light emitter(s) and the ambient environment (and thereby improve heat transfer), especially, in some cases, in devices in which the trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined trim element and mixing chamber sub-assembly) can further comprise one or more reflector and/or reflective film, with any structural aspects of the mixing chamber sub-assembly being provided by the combined trim element and mixing chamber sub-assembly).

In some embodiments, the trim element can comprise at least one chamber that is shaped so that it can accommodate any of a variety of driver modules and/or power supply modules (or one or more components thereof) involved in receiving current supplied to a lighting device, modifying the current (e.g., converting it from AC to DC and/or from one voltage to another voltage), and/or driving one or more solid state light emitters (e.g., illuminating one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power, such as a dimming signal in AC power supplied to the lighting device), e.g., any of the components discussed herein.

In some embodiments according to the present inventive subject matter, a driver module, a power supply module, and/or one or more components can be provided in or on the trim element. For example, such a component (or components) can be selected from among any of (1) the electrical connector (or one or more other electrical connectors), for example, one or more wires (e.g., that can be connected to one or more wire-receiving elements or spliced to other wires), an Edison plug or GU24 pins, (2) one or more electrical components employed in converting electrical power (e.g., from AC to DC and/or from one voltage to another voltage), (3) one or more electrical components employed in driving one or more solid state light emitter, e.g., running one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power (e.g., a dimming signal in AC power supplied to the lighting device), etc., (4) one or more circuit boards (e.g., a metal core circuit board) for supporting and/or providing current to any electrical components, (5) one or more wires connecting any components (e.g., connecting an Edison plug to a circuit board), etc.

In some embodiments, the trim element can be included as part of a trim sub-assembly that comprises a trim element and one or more other structures and/or components. For example, in some embodiments, a trim sub-assembly can be provided that comprises a trim element, a light emitting diode circuit board, a plurality of light emitting diodes mounted on the light emitting diode circuit board, a reflector sheet, and/or clips for holding the trim sub-assembly in place relative to a fixture element.

Various types of electrical connectors are well known to those skilled in the art, and any of such electrical connectors can be attached within (or attached to) the lighting devices according to the present inventive subject matter. Representative examples of suitable types of electrical connectors include wires (for splicing to a branch circuit), Edison plugs (which are receivable in Edison sockets) and GU24 pins (which are receivable in GU24 sockets).

An electrical connector can be electrically connected to the one or more solid state light emitters (or to at least one of the one or more solid state light emitters) in any suitable way. A representative example of a way to electrically connect a solid state light emitter to an electrical connector is to connect a first portion of a flexible wire to the electrical connector and to electrically connect a second portion of the flexible wire to one or more circuit boards that comprise one or more power supply components and/or one or more driver components, such that current can be delivered from such circuit board(s) to one or more circuit boards (e.g., one or more metal core circuit boards) on which the solid state light emitter (or a plurality of solid state light emitters) is/are mounted.

Some embodiments in accordance with the present inventive subject matter can comprise a power line that can be connected to a source of power (such as a branch circuit, a battery, a photovoltaic collector, etc.) and that can supply power to an electrical connector or directly to the lighting device (e.g., the power line itself can be an electrical connector). Persons of skill in the art are familiar with, and have ready access to, a variety of structures that can be used as a power line. A power line can be any structure that can carry electrical energy and supply it to an electrical connector on a lighting device and/or to a lighting device according to the present inventive subject matter.

Energy can be supplied to the lighting devices according to the present inventive subject matter from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

Persons of skill in the art are familiar with, and have ready access to, a wide variety of solid state light emitters, and any suitable solid state light emitter (or solid state light emitters) can be employed in the lighting devices according to the present inventive subject matter. A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Lighting devices according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters (and optionally one or more luminescent materials) can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

In general, light of any number of colors can be mixed by the lighting devices according to the present inventive subject matter. Representative examples of blending of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009-0296384), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference as if set forth in its entirety; and U.S. patent application Ser. No. 12/535,319, filed on Aug. 4, 2009 (now U.S. Patent Publication No. 2011/0031894), the entirety of which is hereby incorporated by reference as if set forth in its entirety.

Some or all of the one or more solid state light emitters can be provided in or on the trim element. Alternatively or additionally, some or all of the one or more solid state light emitters can be provided in or on a mixing chamber sub-assembly (if included), some or all of the one or more solid state light emitters can be provided in or on a driver chamber assembly (if included), and/or some or all of the one or more solid state light emitters can be provided in or on one or more heat sink element or structure (if included).

In some embodiments according to the present inventive subject matter, including some embodiments that include or do not include any of the features as discussed herein, the lighting device can further comprise a mixing chamber sub-assembly, which can be of any suitable shape and size, and can be made of any suitable material or materials. Light emitted by the one or more solid state light emitters can be mixed to a suitable extent in a mixing chamber before exiting the lighting device.

Representative examples of materials that can be used in making a mixing chamber sub-assembly include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments, the mixing chamber sub-assembly can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments, a mixing chamber is defined (at least in part) by the mixing chamber sub-assembly. In some embodiments, a mixing chamber is defined in part by the mixing chamber sub-assembly (or by the trim element) and in part by a lens and/or a diffuser. The expression "defined (at least in part)", e.g., as used in the expression "mixing chamber is defined (at least in part) by the mixing chamber sub-assembly" means that the element or feature that is defined "at least in part" by a particular structure is defined completely by that structure or is defined by that structure in combination with one or more additional structures.

In some embodiments according to the present inventive subject matter, including some embodiments that include or do not include any of the features as discussed herein, the lighting device can comprise a driver sub-assembly, which can be of any suitable shape and size, and can be made of any suitable material or materials. In some embodiments, a driver sub-assembly can comprise a housing that can be made of the same material or materials as (1) the trim element or a portion of the trim element, or (2) a mixing chamber sub-assembly or a portion thereof, and/or a driver sub-assembly (or at least a part thereof, e.g., a cover) can be made of plastic, glass, metal (optionally with one or more insulator), or a flame resistant fiber material.

In some embodiments, a driver sub-assembly can be provided that comprises at least one chamber that is shaped so that it can accommodate any of a variety of driver modules and/or power supply modules (or one or more components thereof) involved in receiving current supplied to a lighting device, modifying the current (e.g., converting it from AC to DC and/or from one voltage to another voltage), and/or driving one or more solid state light emitters (e.g., illuminating one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power, such as a dimming signal in AC power supplied to the lighting device), e.g., any of the components discussed herein.

In some embodiments according to the present inventive subject matter, a driver sub-assembly can be provided that comprises a driver module, a power supply module, and/or one or more components selected from among any of (1) the electrical connector (or one or more other electrical connectors), for example, one or more wires (e.g., that can be connected to one or more wire-receiving elements or spliced to other wires), an Edison plug or GU24 pins, (2) one or more electrical components employed in converting electrical power (e.g., from AC to DC and/or from one voltage to another voltage), (3) one or more electrical components employed in driving one or more solid state light emitter, e.g., running one or more solid state light emitter intermittently and/or adjusting the current supplied to one or more solid state light emitters in response to a user command, a detected change in intensity or color of light output, a detected change in an ambient characteristic such as temperature or background light, etc., and/or a signal contained in the input power (e.g., a dimming signal in AC power supplied to the lighting device), etc., (4) one or more circuit boards (e.g., a metal core circuit board) for supporting and/or providing current to any electrical components, (5) one or more wires connecting any components (e.g., connecting an Edison plug to a circuit board), etc.

A driver sub-assembly, if provided, can be attached to the trim element in any suitable way, e.g., rigidly (for example using screws and/or bolts extending through at least a portion of the trim element and at least a portion of the driver sub-assembly) or flexibly (e.g., as described in U.S. patent application Ser. No. 12/566,936, filed on Sep. 25, 2009, entitled "Lighting Device With Position-Retaining Element" (now U.S. Patent Publication No. 2011/0075423), the entirety of which is hereby incorporated by reference as if set forth in its entirety.

In embodiments where a driver sub-assembly is provided, one or more elements can be positioned (and/or clamped) between the driver sub-assembly and the trim element, e.g., a heat sink element and/or heat sink structure can be positioned between the driver sub-assembly and the trim element (e.g., as described in U.S. patent application Ser. No. 12/566,850, filed on Sep. 25, 2009, entitled "Lighting Device With One Or More Removable Heat Sink Elements" (now U.S. Patent Publication No. 2011/0074265), the entirety of which is hereby incorporated by reference as if set forth in its entirety), a connection element can be positioned between the driver sub-assembly and the trim element (e.g., as described in U.S. patent application Ser. No. 12/566,857, filed on Sep. 25, 2009, entitled "Light Engines For Lighting Devices" (now U.S. Patent Publication No. 2011/0075411), or any other suitable element can be positioned between the driver sub-assembly and the trim element.

In some embodiments according to the present inventive subject matter, including some embodiments that include or do not include any of the features as discussed herein, the lighting device can further comprise one or more connection elements, e.g., as described in U.S. patent application Ser. No. 12/566,857, filed on Sep. 25, 2009, entitled "Light Engines For Lighting Devices" (now U.S. Patent Publication No. 2011/0075411), the entirety of which is hereby incorporated by reference as if set forth in its entirety. A connection element (if included) can be of any suitable shape and size, and can be made of any suitable material or materials. In some embodiments, a connection element can be made of the same material or materials as any part of the trim element (and/or any part of a mixing chamber sub-assembly, if included, and/or any part of a driver sub-assembly, if included). In some embodiments, a connection element (if included) can be integral with the trim element (or with a driver chamber sub-assembly, if included, and/or with a mixing chamber sub-assembly, if included).

The connection element can be provided for any suitable purpose, e.g., to enable one or more heat sink elements or structures, a mixing chamber sub-assembly, a driver sub-assembly, one or more power supply modules, one or more driver modules, and/or one or more fixture elements, to be easily attached to the trim element (and/or for any one of the above to be attached to any other of the above).

In some embodiments, the connection element (or at least one of the connection elements) has one or more apertures and/or one or more mounting surfaces which can be used in connecting the connection element to one or more structures (and/or in connecting two or more structures to each other).

In some embodiments according to the present inventive subject matter, including some embodiments that include or do not include any of the features as discussed herein, the trim element, a mixing chamber sub-assembly (if included), a driver sub-assembly (if included), a connection element (if included), and/or any other structure in the lighting device, can assist in dissipating heat from the one or more solid state light emitters and/or any other component and/or portion of the lighting device.

In some embodiments according to the present inventive subject matter, including some embodiments that include or do not include any of the features as discussed herein, the lighting device can further comprise at least one heat sink element or structure that can be of any of a wide variety of shapes and sizes.

In some embodiments, the lighting device comprises one or more removable or integral heat sink elements or structures. The expression "removable", as used herein when referring to one or more heat sink elements or structures, means that the heat sink element or structure (or elements or structures) can be removed from the lighting device without severing any material, e.g., by loosening and/or removing one or more screws or bolts and removing the heat sink element or structure (or elements or structures) from the lighting device.

In some embodiments, including some embodiments that include or do not include any of the features described above, one or more heat sink element or structures (which may be removable) can be selected and attached to the lighting device so as to provide a desired rate of heat dissipation capability under specific circumstances (e.g., when all of the light sources in the lighting device are fully illuminated and after thermal equilibrium has been reached, and under typical air flow conditions), based on the heat generation characteristics of the one or more light sources that are provided in (or that will be provided in) the lighting device.

The expression "after thermal equilibrium has been reached" refers to supplying current to one or more light sources in a lighting device to allow the light source(s) and other surrounding structures to heat up to (or near to) a temperature to which they will typically be heated when the lighting device is illuminated. The particular duration that current should be supplied will depend on the particular configuration of the lighting device. For example, the greater the thermal mass, the longer it will take for the light source(s) to approach their thermal equilibrium operating temperature. While a specific time for operating the lighting device prior to reaching thermal equilibrium may be lighting device specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) without a change in ambient or operating conditions.

A heat sink element or structure (and any additional heat sink elements or structures), if included, can be made from any suitable material or combination of materials, a wide variety of which will be apparent to persons skilled in the art. In lighting devices that comprise more than one heat sink element or structure, any of the different heat sink elements or structures can be made of differing materials or combinations of materials.

Representative examples of materials that can be employed in making heat sink elements or structures include, for example, materials that inherently have high thermal conductivities, such as metals, metal alloys, ceramics, and polymers mixed with ceramic or metal or metalloid particles. One of the more common materials is aluminum.

The at least one heat sink element or structure (when included) can be any suitable element(s) or structure(s). Representative examples of structures that can be used as heat sink elements or structures in accordance with the present inventive subject matter are described in:

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 12/411,905, filed on Mar. 26, 2009 (now U.S. Patent Publication No. 2010/0246177), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,828, filed on May 21, 2009 (now U.S. Patent Publication No. 2010/0103678), the entirety of which is hereby incorporated by reference as if set forth in its entirety; and U.S. patent application Ser. No. 12/566,850, filed on Sep. 25, 2009, entitled "Lighting Device With One Or More Removable Heat Sink Elements" (now U.S. Patent Publication No. 2011/0074265), the entirety of which is hereby incorporated by reference as if set forth in its entirety.

Any suitable circuitry (including any suitable electronic components) can be employed in order to supply energy to the one or more solid state light emitters according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety;

U.S. patent application Ser. No. 12/328,115, filed on Dec. 4, 2008 (now U.S. Patent Publication No. 2009-0184662), the entirety of which is hereby incorporated by reference as if set forth in its entirety.

U.S. patent application Ser. No. 12/566,142, filed on Sep. 24, 2009, entitled "Solid State Lighting Apparatus With Configurable Shunts" (now U.S. Patent Publication No. 2011-0068696), the entirety of which is hereby incorporated by reference as if set forth in its entirety; and U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011-0068702), the entirety of which is hereby incorporated by reference as if set forth in its entirety.

For example, solid state lighting systems have been developed that include a power supply that receives the AC line voltage and converts that voltage to a voltage (e.g., to DC and to a different voltage value) and/or current suitable for driving solid state light emitters. Typical power supplies for light emitting diode light sources include linear current regulated supplies and/or pulse width modulated current and/or voltage regulated supplies.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg Johansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

In some embodiments according to the present inventive subject matter, there is provided a lighting device in which one or more components as discussed herein (e.g., one or more electrical components involved in receiving current supplied to a lighting device, modifying the current, and/or driving one or more solid state light emitters) is/are provided in the trim element, and/or in which one or more of such components is/are provided in a driver sub-assembly, in a mixing chamber sub-assembly, or partially in each of two or more regions, e.g., partially in each of a driver sub-assembly and a mixing chamber sub-assembly.

In some embodiments of lighting devices according to the present inventive subject matter, a power supply and/or a driver (or one or more components thereof) can be provided elsewhere, i.e., not in the lighting device. In some embodiments of lighting devices according to the present inventive subject matter, some components of a power supply (or of a driver) can be provided in the trim element, and/or one or more of such components can be provided in a driver sub-assembly, in a mixing chamber sub-assembly, or partially in each of a driver sub-assembly and a mixing chamber sub-assembly.

Different driver modules and/or power supply modules can be provided that include any of such components selected and/or combined to be suitable to connect to any given power input and to drive any solid state light emitter or combination of solid state light emitters connected to each other in any way, and to drive the solid state light emitter or solid state light emitters in any suitable way.

Various electronic components in the lighting device can be mounted in any suitable way. For example, in some embodiments, light emitting diodes can be mounted on a first circuit board (a "light emitting diode circuit board") and electronic circuitry that can convert AC line voltage into DC voltage suitable for being supplied to light emitting diodes can be mounted on a second circuit board (a "driver circuit board"), whereby line voltage is supplied to the electrical connector and passed along to the driver circuit board, the line voltage is converted to DC voltage suitable for being supplied to light emitting diodes in the driver circuit board, and the DC voltage is passed along to the light emitting diode circuit board where it is then supplied to the light emitting diodes. In some embodiments according to the present inventive subject matter, at least the light emitting diode circuit board is a metal core circuit board.

In some embodiments, at least one fixture element can be attached to the lighting device according to the present inventive subject matter. A fixture element, when included, can comprise a housing, a mounting structure, and/or an enclosing structure. Persons of skill in the art are familiar with, and can envision, a wide variety of materials out of which a fixture element, a housing, a mounting structure and/or an enclosing structure can be constructed, and a wide variety of shapes for such a fixture element, a housing, a mounting structure and/or an enclosing structure. A fixture element, a housing, a mounting structure and/or an enclosing structure made of any of such materials and having any of such shapes can be employed in accordance with the present inventive subject matter.

For example, fixture elements, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety; and U.S. patent application Ser. No. 12/469,828, filed on May 21, 2009 (now U.S. Patent Publication No. 2010/0103678), the entirety of which is hereby incorporated by reference as if set forth in its entirety.

In some embodiments, a fixture element, if provided, can further comprise an electrical connector that engages an electrical connector on the lighting device or is electrically connected to the lighting device In some embodiments, an electrical connector is provided that is substantially non-moving relative to the fixture element, e.g., the force normally employed when installing an Edison plug in an Edison socket does not cause the Edison socket to move more than one centimeter relative to the housing, and in some embodiments, not more than ½ centimeter (or not more than ¼ centimeter, or not more than one millimeter, etc.). In some embodiments, an electrical connector that engages an electrical connector on the lighting device can move relative to a fixture element, and structure can be provided to limit movement of the lighting device relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, lighting devices can comprise one or more structures that engage structure in a fixture element to hold the lighting device in place relative to the fixture element. Any suitable element(s) or structure(s) can be provided in order to hold a lighting device relative to a fixture element, and persons of skill in the art are familiar with such elements and structures, and can envision a wide range of such elements and structures. In some embodiments, the lighting device can be biased against a fixture element, e.g., so that a flange portion of a trim element is maintained in contact (and forced against) a bottom region of a fixture element (e.g., a circular extremity of a cylindrical can light housing). For example, some embodiments include one or more spring retainer clips (sometimes referred to as "chicken claws") which comprise at least first and second spring-loaded arms (attached to a lighting device or to a trim element that is attached to a lighting device) and at least one engagement element (attached to a fixture element), the first and second spring loaded arms being spring biased apart from each other (or toward each other) into contact with opposite sides of the engagement element, creating friction which holds the lighting device in position relative to the fixture element, while permitting the trim element to be moved to different positions relative to the fixture element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can have a hook at a remote location, which can prevent the lighting device from being moved away from the fixture element beyond a desired extreme location (e.g., to prevent the lighting device from falling out of the fixture element).

As noted above, additional examples of structures that can be used to hold a lighting device in place relative to a fixture element are disclosed in U.S. patent application Ser. No. 11/877,038, filed Oct. 23, 2007 (now U.S. Patent Publication No. 2008/0106907), the entirety of which is hereby incorporated by reference as if set forth in its entirety).

Another example of a structure that can be used to hold a lighting device in place relative to a fixture element is a telescoping element, i.e., an element that has at least first and second sections that telescope relative to each other, the lighting device (or a trim element attached to the lighting device) being connected to the first section, the second section being connected to the fixture element.

Another example of a structure that can be used to hold a lighting device in place relative to a fixture element is an axial spring, where the lighting device (or a trim element attached to the lighting device) is connected to a first region of the axial spring and a second region of the axial spring is connected to the fixture element. In some embodiments, the lighting device (or a trim element attached to the lighting device) can be attached (via an axial spring) to a first region of the fixture element, and the lighting device (or a trim element attached to the lighting device) can be biased by the axial spring into engagement with a second region of the fixture element (e.g., a circular lowermost edge of a cylindrical can) or with a construction element to which the fixture element is attached (e.g., a lower flange of a trim element attached to the lighting device can be biased by the axial spring upward into engagement with a ceiling in which the fixture element is mounted).

Another example of a structure that can be used to hold a lighting device in place relative to a fixture element is a ratcheting element in which a ratcheting portion can be pushed in a first direction relative to a ratcheting receptacle but not in an opposite direction, the lighting device (or a trim element attached to the lighting device) is connected to one of the ratcheting portion and the ratcheting receptacle, and the fixture element is connected to the other of the ratcheting portion and the ratcheting receptacle, whereby the lighting device (or a trim element attached to the lighting device) can be incrementally moved in one direction (but not the other direction) relative to the fixture element.

Another example of a structure that can be used to hold a lighting device in place relative to a fixture element is a retracting reel, in which a reel is spring biased to rotate in a direction in which it would wind up a cable, one of the lighting device (or a trim element attached to the lighting device) and the fixture element is connected to the reel and the cable is connected to the other of the lighting device (or a trim element attached to the lighting device) and the fixture element, whereby the structure connected to the cable can be moved away from the other structure by a force which causes the cable to wind out of the reel, and the spring bias of the reel biases the lighting device (or a trim element attached to the lighting device) and the fixture element toward each other (for instance, a trim element attached to the lighting device can be biased by the reel upward into engagement with a ceiling in which the fixture element is mounted).

Some embodiments in accordance with the present inventive subject matter can include one or more lenses or diffusers. Persons of skill in the art are familiar with a wide variety of lenses and diffusers, can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

One or more scattering elements (e.g., layers) can optionally be included in the lighting devices according to the present inventive subject matter. A scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

In many situations, the lifetime of solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device is/are selected so as to extract heat from the solid state light emitter(s) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any heat sink element or structure (if included) (or other element, structure, elements or structures) can comprise one or more thermal transfer region(s) that has/have an elevated heat conductivity (e.g., higher than the rest of that heat sink element or structure, or other element or structure). A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

The lighting devices according to the present inventive subject matter can further comprise elements that help to ensure that the perceived color (including color temperature) of the light exiting the lighting device (or a mixing chamber, if included) is accurate (e.g., within a specific tolerance). A wide variety of such elements and combinations of elements are known, and any of them can be employed in the lighting devices according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety; and U.S. patent application Ser. No. 12/469,819, filed on May 21, 2009 (now U.S. Patent Publication No. 2010/0102199), the entirety of which is hereby incorporated by reference as if set forth in its entirety.

The lighting devices of the present inventive subject matter can be arranged in generally any suitable orientation, a variety of which are well known to persons skilled in the art. For example, the lighting device can be a back-reflecting device or a front-emitting device.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

FIGS. 1-8 schematically depict a lighting device 100 in accordance with the present inventive subject matter.

Figure 2:
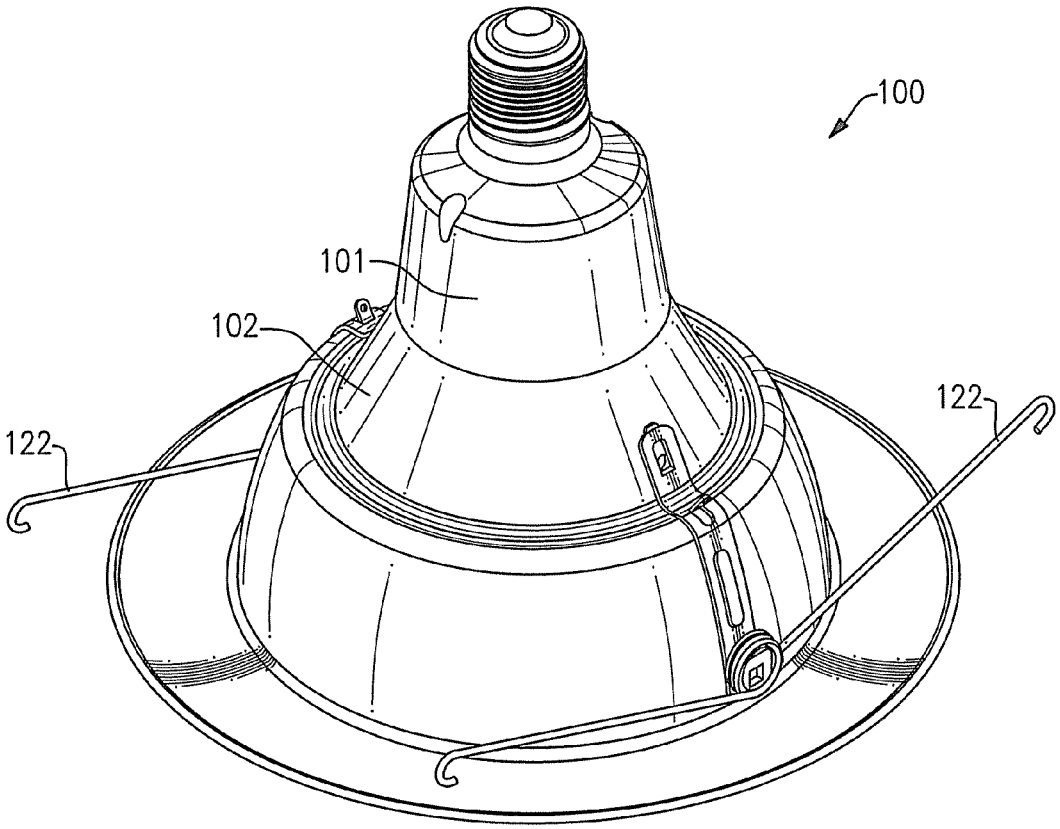
FIG. 2 is a perspective view of the lighting device 100.

FIG. 1 is an exploded perspective view of the lighting device 100, and FIG. 2 is a perspective view of the lighting device 100.

The lighting device 100 (see FIG. 1) comprises a driver sub-assembly 101, a trim sub-assembly 102 and a mixing chamber sub-assembly 103.

Figure 3:
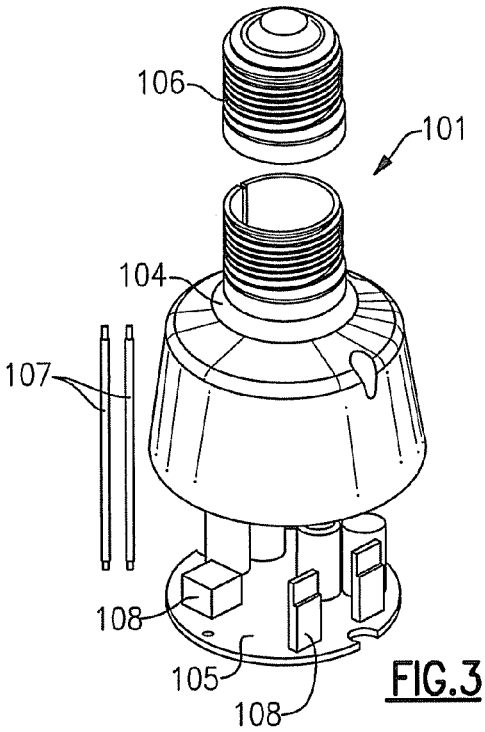
FIG. 3 is an exploded perspective view of a driver sub-assembly 101 of the lighting device 100.
Figure 4:
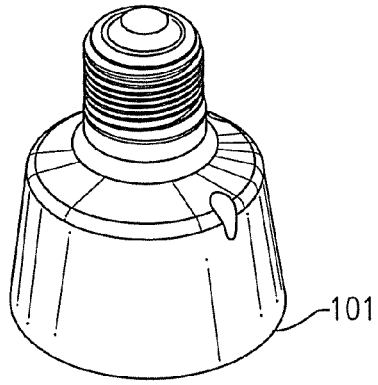
FIG. 4 is a perspective view of the driver sub-assembly 101.

FIG. 3 is an exploded perspective view of the driver sub-assembly 101, and FIG. 4 is a perspective view of the driver sub-assembly 101.

Figure 5:
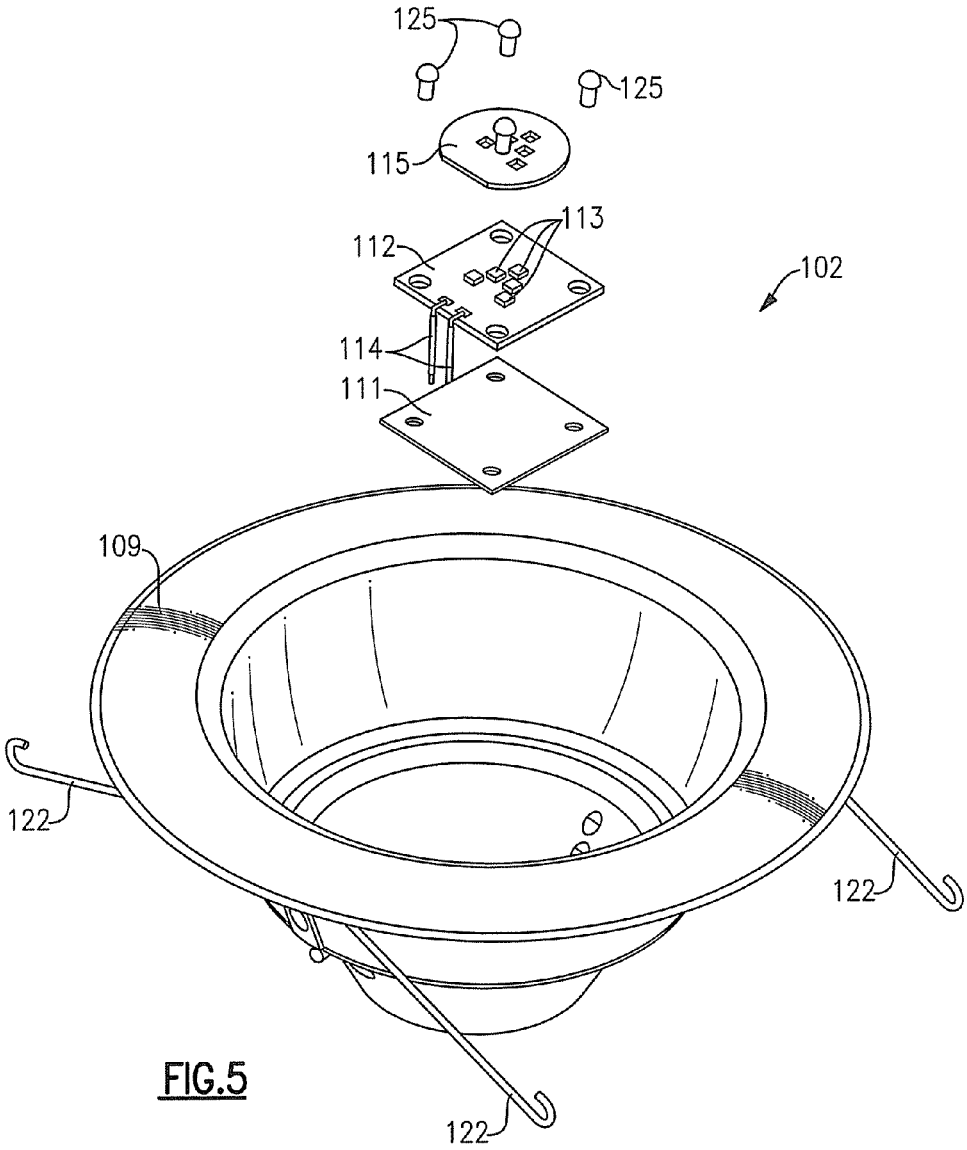
FIG. 5 is an exploded perspective view of a trim sub-assembly 102 of the lighting device 100.
Figure 6:
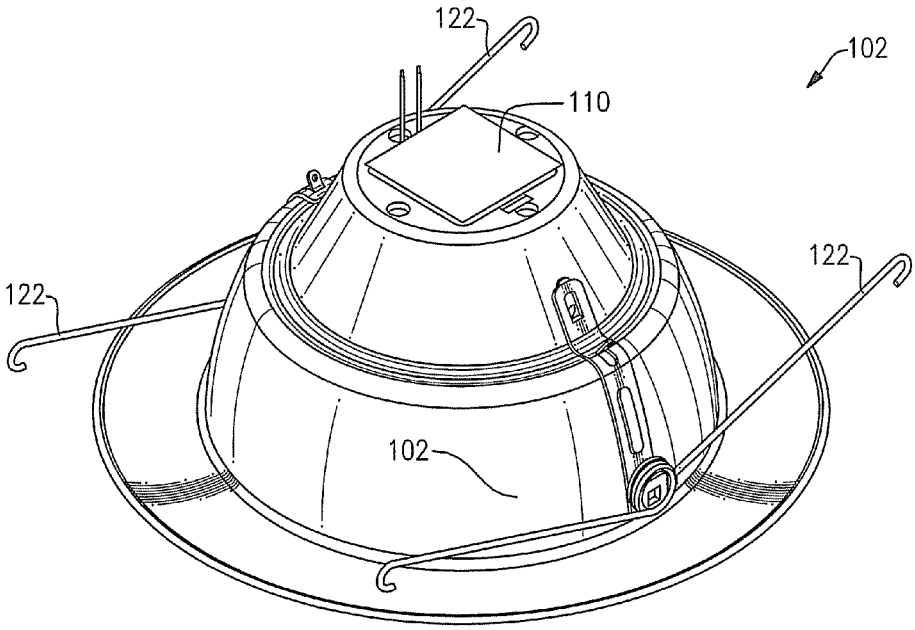
FIG. 6 is a perspective view of the trim sub-assembly 102.

FIG. 5 is an exploded perspective view of the trim sub-assembly 102, and FIG. 6 is a perspective view of the trim sub-assembly 102.

Figure 7:
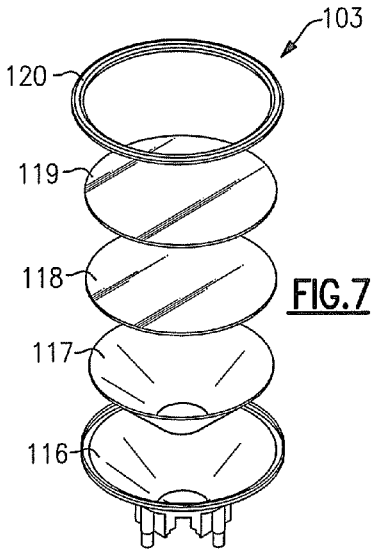
FIG. 7 is an exploded perspective view of a mixing chamber sub-assembly 103 of the lighting device 100.
Figure 8:
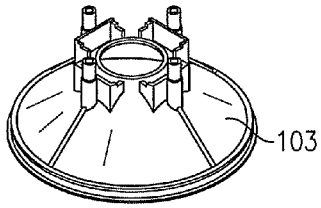
FIG. 8 is a perspective view of the mixing chamber sub-assembly 103.

FIG. 7 is an exploded perspective view of the mixing chamber sub-assembly 103, and FIG. 8 is a perspective view of the mixing chamber sub-assembly 103.

The driver sub-assembly 101 (see FIG. 3) comprises a housing 104, a driver circuit board 105, an Edison screw 106 and input wires 107. A plurality of circuitry components 108 are mounted on the driver circuit board 105. In this embodiment, the housing 104 is made of plastic, but alternatively it can be made of any other suitable material or materials.

The trim sub-assembly 102 (see FIG. 5) comprises a trim element 109, electrical insulation 110 (or a Formex sheet or any other suitable electrically insulating element) (see FIG. 6), a thermally conductive pad 111, a light emitting diode circuit board 112, a plurality of light emitting diodes 113 (mounted on the light emitting diode circuit board 112), light emitting diode board wires 114 and a reflector sheet 115. The insulation 110 can be any suitable material for providing ample electrical insulation between the driver circuit board 105 and the light emitting diode circuit board 112, e.g., insulation tape, Formex sheet, etc.

The mixing chamber sub-assembly 103 (see FIG. 7) comprises a mixing chamber element 116, a mixing chamber reflector 117, a diffuser film 118, a lens 119 and a lens retainer 120. In this embodiment, the mixing chamber element 116 is made of plastic, but alternatively it can be made of any other suitable material or materials. In this embodiment, the lens 119 is made of glass, but alternatively it can be made of any other suitable material or materials. The lens retainer 120 can be of any suitable design, e.g., as described in:

- U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety; and
- U.S. patent application Ser. No. 11/948,041, filed Nov. 30, 2007 (now U.S. Patent Publication No. 2008/0137347), the entirety of which is hereby incorporated by reference as if set forth in its entirety.

The driver sub-assembly 101 can be assembled by soldering one end of each of the input wires 107 to the driver circuit board 105, inserting the driver circuit board 105 into the housing 104, soldering the other end of each of the input wires 107 to the Edison screw 106, and gluing the Edison screw 106 to the housing 104.

The trim sub-assembly 102 can be assembled by applying the insulation 110 to the trim element 109 (alternatively, the insulation 110 can simply rest between the trim sub-assembly 102 and the driver sub-assembly 101). Trim sub-assembly nuts (into which trim sub-assembly bolts will be received, as described later) can be positioned in an assembly jig, then the trim element 109 can be placed in the assembly jig, then the light emitting diode board wires 114 can be soldered to the light emitting diode circuit board 112. The wires between the driver and the light emitting diode circuit board 112 can previously have been connected to the driver circuit board 105 (i.e., prior to assembly of the driver sub-assembly).

The end of the wire that is connected to the light emitting diode circuit board 112 may include a connector to allow for easy connection to the light emitting diode circuit board 112, or it can be soldered to save cost. Alternatively, the wires may be soldered to the light emitting diode circuit board 112 and may have a connecter at the end that connects to the driver circuit board 105 (and/or to a driver end of a power supply unit), in which case the cable and the connector could plug into a mating socket on the underside of the driver circuit board 105. Then, the thermal pad 111 and the light emitting diode circuit board 112 can be placed in the trim element 109, then trim sub-assembly bolts can be inserted through holes in the light emitting diode circuit board 112 and through corresponding holes in the thermal pad 111 and into the trim sub-assembly nuts, and then the reflector sheet 115 can be applied onto the light emitting diode circuit board 112 (with the illumination surfaces of the light emitting diodes 113 aligned with corresponding openings in the reflector sheet 115). Instead of the trim sub-assembly bolts and trim sub-assembly nuts, any other connecting elements can be employed, e.g., spring clips, screws, rivets, adhesive, etc.

The mixing chamber sub-assembly 103 can be assembled by placing the mixing chamber reflector 117 on the mixing chamber element 116, placing the diffuser film 118 and the lens 119 in the mixing chamber element 116, and snap-fitting the lens retainer 120 on the mixing chamber element 116. In some embodiments, the mixing chamber reflector 117 may be attached to the mixing chamber element 116, for example, by press fitting or by an adhesive to secure the mixing chamber reflector 117 to the mixing chamber element 116.

The lighting device 100 can be assembled by placing the mixing chamber sub-assembly 103 in an assembly jig, placing the trim sub-assembly 102 in the assembly jig, soldering the light emitting diode board wires 114 to the driver circuit board 105, placing the driver sub-assembly 101 in the assembly jig, inserting screws 126 through openings provided in the driver sub-assembly 101, through corresponding openings provided in the trim sub-assembly 102 and into corresponding holes provided in the mixing chamber sub-assembly 103 and tightening the screws down. Then, if desired, screw hole covers 124 can be inserted into the openings in the driver sub-assembly 101 to cover the screws and provide a smooth surface on the driver sub-assembly 101. Instead of the screws, any other connecting elements can be employed, e.g., nut and bolt combinations, spring clips, rivets, adhesive, etc.

The lighting device 100 depicted in FIGS. 1-8 can also include spring retainer clips which each include first and second spring-loaded arms 122 that are engageable in a corresponding engagement element mounted on a fixture in which the lighting device 100 is positioned. Each pair of first and second spring loaded arms 122 can be spring biased apart from each other into contact with opposite sides of the corresponding engagement element, creating friction which holds the lighting device 100 in position relative to the fixture, while permitting the lighting device 100 to be moved to different positions relative to the fixture (alternatively, the first and second spring loaded arms 122 can be spring biased toward each other into contact with opposite sides of a corresponding engagement element, thereby similarly creating friction which holds the lighting device 100 in position relative to the fixture, while permitting the lighting device 100 to be moved to different positions relative to the fixture). Instead of the spring retainer clips, the lighting device can include any other suitable structure for adjustably holding the lighting device 100 in place relative to a fixture.

Although a description of the assembly of the driver sub-assembly 101, the trim sub-assembly 102, the mixing chamber sub-assembly 103 and the lighting device 100 is set forth above, the lighting device 100 and the components thereof can be assembled in any other suitable way.

Figure 9:
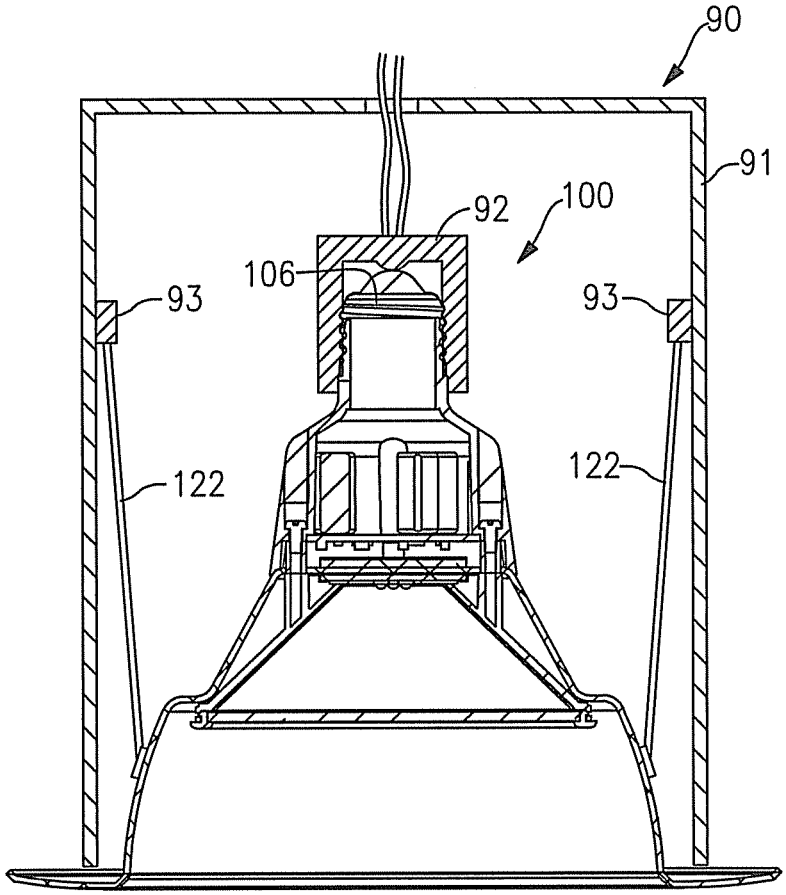
FIG. 9 depicts a light fixture 90 in accordance with the present inventive subject matter.

FIG. 9 depicts a light fixture 90 in accordance with the present inventive subject matter. The light fixture 90 comprises a lighting device 100 as depicted in FIGS. 1-8, as well as a housing 91 and an electrical connector 92. The electrical connector 106 (i.e., the Edison plug) of the lighting device 100 is received in the electrical connector 92 (i.e., the Edison socket). The first and second pairs of spring-loaded arms 122 of the spring retainer clips in the lighting device 100 are engaged in corresponding engagement elements 93 mounted on the housing 91 to hold the lighting device 100 in place relative to the housing 91.

In any lighting device in accordance with the present inventive subject matter, the solid state light emitter, or one or more of the solid state light emitters, can be mounted directly on the trim element (and/or, when a mixing chamber sub-assembly is included, directly on a portion of the mixing chamber sub-assembly). In such devices, power can be delivered to the solid state light emitter or solid state light emitters that is/are mounted directly on the trim element (and/or on a trim element) in any suitable way, e.g., through conductive traces provided on the trim element (and/or on a mixing chamber sub-assembly), through wires connected to one or more circuit boards, through traces embedded in the trim element (and or a mixing chamber sub-assembly), through contacts that extend through the trim element (and/or a mixing chamber sub-assembly), etc.

Mounting solid state light emitters directly on the trim element (and/or on a mixing chamber sub-assembly) can reduce or minimize the thermal interfaces between the solid state light emitters and the ambient environment where the trim element (and/or a mixing chamber sub-assembly) acts as a heat sink for the solid state light emitters and is exposed to a room. Mounting solid state light emitters directly on the trim element (and/or a mixing chamber sub-assembly) can also eliminate the cost of a metal core circuit board. In other devices, one or more solid state light emitters could be mounted on a circuit board (e.g., a metal core circuit board) that is mounted on the trim element (and/or a mixing chamber sub-assembly).

In some lighting devices in which the solid state light emitter or one or more of the solid state light emitters is/are mounted directly on the trim element, one or more thermal element can be provided that is on the trim element in a location where it can serve a specific solid state light emitter or group of solid state light emitters. A representative example of a suitable thermal element is a projection that extends from the side of the trim element that is opposite the side on which the solid state light emitter(s) is/are mounted. Alternatively or additionally a portion of the heat sink adjacent to the solid state light emitter (or solid state light emitters) can be removed (and optionally filled with a thermal element or a part of a thermal element). A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device, comprising:
a trim element;
an electrical connector;
at least a first driver component; and
at least one solid state light emitter,
the lighting device weighing less than 750 grams,
at least one of the at least one solid state light emitter mounted on the trim element,
the trim element defining a trim element space,
the first driver component in the trim element space,
wherein if about 12 watts is supplied to the electrical connector, the at least one solid state light emitter will illuminate so that the lighting device will emit white light of at least 500 lumens.

2. A lighting device as recited in claim 1, wherein the trim element and the at least one solid state light emitter are shaped and positioned to provide a shield angle of at least 15 degrees.

3. A lighting device as recited in claim 1, wherein the lighting device further comprises at least a first fixture element.

4. A lighting device as recited in claim 3, wherein the lighting device further comprises at least one structure that holds the trim element in position relative to the first fixture element.

5. A lighting device as recited in claim 1, if electricity is supplied to the lighting device to cause the lighting device to emit light having a brightness of at least 500 lumens, the temperature of the at least one solid state light emitter would be maintained at or below a 25,000 hour rated lifetime junction temperature for the solid state light emitter in a 25° C. surrounding environment.

6. A lighting device as recited in claim 1, wherein said about 12 watts is supplied with AC electricity.

7. A lighting device as recited in claim 1, wherein the trim element comprises at least a portion of a mixing chamber sub-assembly.

8. A lighting device as recited in claim 1, wherein the lighting device weighs less than 500 grams.

9. A lighting device, comprising:
a trim element;
an electrical connector;
at least a first driver component; and
at least one solid state light emitter,
the lighting device weighing less than 750 grams,
at least one of the at least one solid state light emitter mounted on the trim element,
the trim element defining a trim element space,
the first driver component in the trim element space,
wherein if about 15 watts is supplied to the electrical connector, the at least one solid state light emitter will illuminate so that the lighting device will emit white light of at least 500 lumens.

10. A lighting device, comprising:
a trim element;
an electrical connector;
at least a first driver component; and
at least one solid state light emitter,
the lighting device weighing less than 750 grams,
at least one of the at least one solid state light emitter mounted on the trim element,
the trim element defining a trim element space,
the first driver component in the trim element space,
wherein if not more than about 15 watts is supplied to the electrical connector, the at least one solid state light emitter will illuminate so that the lighting device will emit white light of at least 500 lumens.

11. A lighting device, comprising:
a trim element;
an electrical connector;
at least a first driver component; and
at least one solid state light emitter,
the lighting device weighing less than 750 grams,
at least one of the at least one solid state light emitter mounted on the trim element,
the trim element defining a trim element space,
the first driver component in the trim element space,
wherein the lighting device can generate white light of at least 500 lumens using not more than about 15 watts.

12. A lighting device for mounting in a recessed housing, comprising:
a unitary structure trim element comprising a thermally conductive material and configured to extend from within the recessed housing through an aperture in the recessed housing and includes a flange element that extends beyond the aperture of the recessed housing and prevents insertion of the trim element fully within the recessed housing; and
at least one solid state light emitter mounted on the unitary structure trim element, wherein the trim element conducts heat away from the at least one solid state light emitter and dissipates at least some of the heat outside of the recessed housing.

13. A lighting device as recited in claim 12, wherein the lighting device exclusive of the recessed housing has a total mass of less than about 750 grams.

14. A lighting device as recited in claim 13, wherein the trim element defines an aperture of the lighting device that has a diameter of at least about 4.5 inches and a lumen output of at least about 575 lumens.

* * * * *

UNITED STATES PATENT AND TRADEMARK OFFICE

CERTIFICATE OF CORRECTION

PATENT NO. : 8,777,449 B2
APPLICATION NO. : 12/566861
DATED : July 15, 2014
INVENTOR(S) : Antony Paul Van De Ven, Wai Kwan Chan and Ho Chin Wah It is certified that error appears in the above-identified patent and that said Letters Patent is hereby corrected as shown below:

On the Title Page, Item (56) Other Publications

Please correct: "U.S. Appl. No. 12/441,905, filed March 26, 2009." to -- U.S. Appl. No. 12/411,905, filed March 26, 2009. --

Please correct: "Illuminating Engineering Society Siandard LM-80-08, entitled "*IES Approved Method for Measuring Lumen Maintenance of LED Light Sources*", Sep. 22, 2008, ISBN No. 978-0-87995,227-3." to -- Illuminating Engineering Society Standard LM-80-08, entitled "*IES Approved Method for Measuring Lumen Maintenance of LED Light Sources*", Sep. 22, 2008, ISBN No. 978-0-87995,227-3. --

Signed and Sealed this
Fourteenth Day of October, 2014

Michelle K. Lee

Michelle K. Lee
*Deputy Director of the United States Patent and Trademark Office*